US006349654B1

(12) United States Patent
Peters

(10) Patent No.: US 6,349,654 B1
(45) Date of Patent: Feb. 26, 2002

(54) TABLE STRUCTURE FOR CHILDREN'S PLAY

(76) Inventor: William H. Peters, 16795 County Rd. I-50, West Unity, OH (US) 43570

( * ) Notice: Subject to any disclaimer, the term of this patent is extended or adjusted under 35 U.S.C. 154(b) by 0 days.

(21) Appl. No.: 09/372,068

(22) Filed: Aug. 11, 1999

(51) Int. Cl.[7] ..... A47B 77/06
(52) U.S. Cl. ..... 108/26; 312/228; 248/146
(58) Field of Search ..... 248/146, 149, 248/150; 108/25, 26, 26.2, 24; 312/228, 229, 232

(56) References Cited

U.S. PATENT DOCUMENTS

| | | | | | |
|---|---|---|---|---|---|
| 49,821 | A | * | 9/1865 | Ziegler | 108/25 X |
| 451,346 | A | * | 4/1891 | Tweeddale | 312/228 X |
| 1,201,903 | A | * | 10/1916 | Wiley | 108/129 X |
| 1,474,872 | A | * | 11/1923 | Witt | 248/146 |
| 1,955,610 | A | * | 4/1934 | Seipt | 220/23.88 X |
| 2,022,591 | A | * | 11/1935 | Everitt | 312/228 X |
| 3,162,495 | A | * | 12/1964 | Swift | 108/25 X |
| 5,640,911 | A | * | 6/1997 | Peters | 108/26 |

FOREIGN PATENT DOCUMENTS

| | | | | |
|---|---|---|---|---|
| CH | 356786 | * | 10/1961 | 312/228 |
| DE | 661625 | * | 5/1938 | 108/25 |
| DE | 2426720 | * | 12/1975 | 312/228 |
| FR | 2300520 | * | 10/1976 | 108/25 |

* cited by examiner

*Primary Examiner*—Peter M. Cuomo
*Assistant Examiner*—Hanh V. Tran

(57) ABSTRACT

The concept herein is focused on an apparatus centered on a sand and water table, as used by young children for play and educational purposes, such sand and water table comprising an upright table having a depressed container area, which is open at the top for access from above with an upper table perimeter portion around the upper edge of the depressed container area, into which table perimeter portion is formed a recessed channel area that has dual functions, one being to help prevent spillage of sand, water, or other substances from the depressed container area, with the additional concept including an interior lining member that is adapted to fit conformingly into the open depressed container area, with the liner having an upper opening edge which opening edge is provided with an outwardly extending flat ledge adapted to rest on an inner portion of the perimeter portion of such table with an outer partially looped portion affixed to the outer perimeter of the flat ledge of the liner, which partially looped portion is adapted to fit conformingly over the most outer part of the table perimeter portion.

2 Claims, 4 Drawing Sheets

TABLE STRUCTURE FOR CHILDREN'S PLAY

KNOWN PRIOR ART

U.S. Pat. No. 5,640,911 and all patents referred to therein

DISCUSSION OF PRIOR ART AND BACKGROUND OF INVENTION

The subject apparatus is directed to items that are used to help educate young children, particularly pre-school children, in learning activities. Many of these educational items are adapted and structured to permit young children to use their hands in combined play and work activities.

One such apparatus used in the educational development of young children is the sand and water table that features a tub-like member in which water and sand are placed to allow children to manipulate and work with the dampened sand. Usually, these tub-like members are supported on an upright table so that the depressed area of the tub-like member is accessible for use while the child stands or is seated. These sand and water tables vary in size, structure, shape and design. However, one of the common problems encountered with the usage of such tables is that they are not structured to help alleviate the problem of sand and water falling up and over the side edges of the table when used by the young children. This particular problem is addressed by this invention, as seen in the following objects.

Yet another problem that prevails with existing water table structures is that the upper portions of such tables are generally not structured to receive a conforming lid that effectively covers, secures, and seals the table when the table is not being used. Most existing water and sand tables are not structured so as to effectively be covered with a corresponding lid member that seals the tub portion holding the water and sand and prevents ingress and egress of water and debris to and from the inner part of the table. The subject invention is further structured so as to provide a table top edge that is adapted to receive conformingly a lid member that properly seals the tub contents.

The invention herein contemplates the use of a liner member that is seated within the confines of the recessed basin used in such tables which liner member is provided with means on its opening perimeter edge to seat over the extreme outer, upper edges of the table so that water or debris can't enter or leave the inner areas of the table. Accordingly, the following aspects of the subject invention are directed accordingly.

OBJECTS OF INVENTION

The following are objects of the subject invention:

It is an object of the subject apparatus to provide an improved water and sand table lining structure;

It is also an object of the subject invention to provide a water and sand table that possesses features to minimize the overflow of sand and water over the table edges;

An additional object of the subject invention is to provide an improved liner structure for a sand and water table;

Still another object of the subject invention is to provide an improved water table structure to accommodate an accommodating secure lid structure;

A further object of the subject invention is to provide an improved perimeter edge structure for a tub member;

Yet another object of the subject invention is to provide an improved structure to seal a sand and water tub;

A further object of the subject invention is to provide an improved sand and water table for children's usage that prevents water and moisture and other spillage on adjacent floors;

Still another object of the subject invention is to provide an improved water table construction that maintains all water and other substances within the confines of the table;

Yet another object of the subject invention is to provide an improved liner member for children's sand and water table;

Other and further objects of the subject invention can be seen in the following description and claims read in view of the drawings.

IN THE DRAWINGS

FIG. 1 is an end elevational view of the subject invention, in section;

FIG. 2 an end elevational view of the subject invention;

DESCRIPTION OF GENERAL EMBODIMENT

Figure 1:
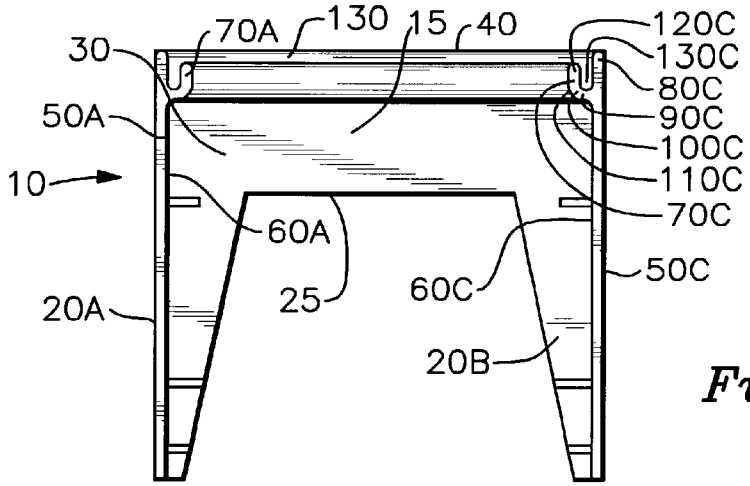
Figure 2:
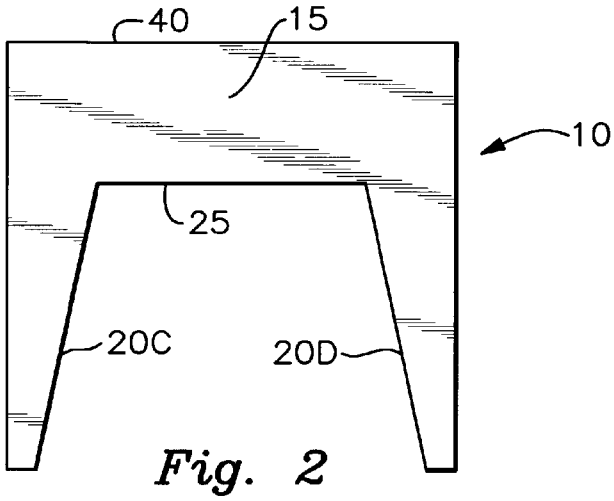
Figure 3:
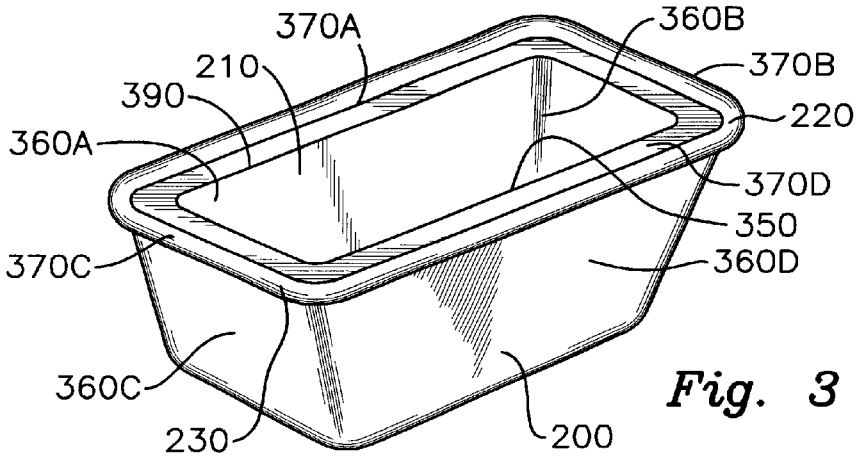
FIG. 3 is a perspective view of a basin insert.
Figure 4:
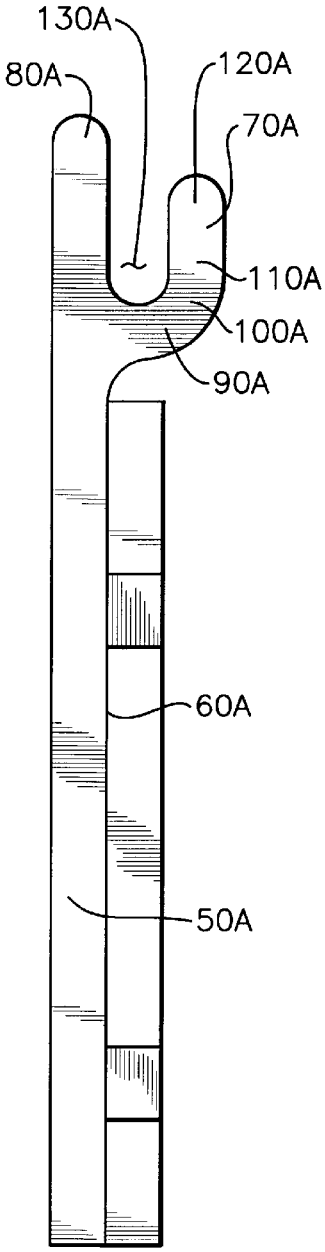
FIG. 4 is a side elevational view of a side member of the base top member.
Figure 8:
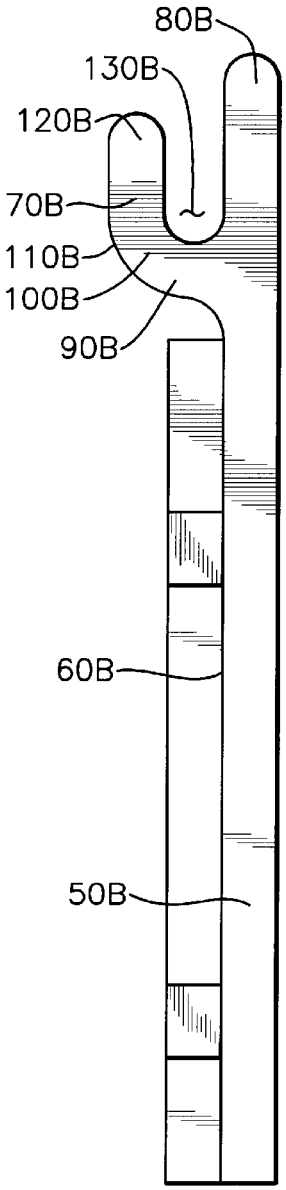
FIG. 8 is a side elevational view of the side member.
Figure 9:
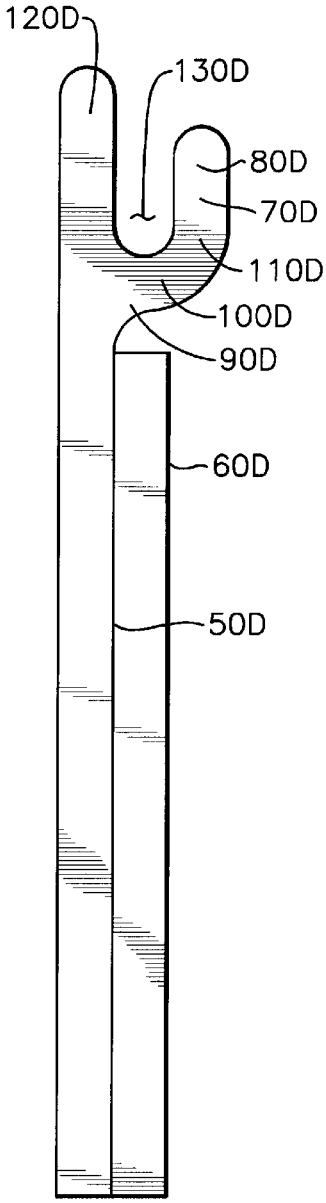
FIG. 9 is a side elevational view of the second side member.
Figure 5:
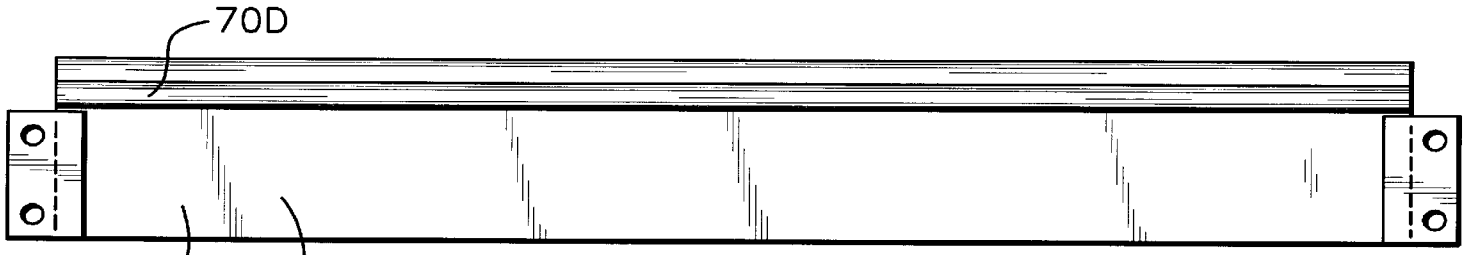
FIG. 5 is an end side elevational view from the inside of a side member of the base top member.
Figure 6:
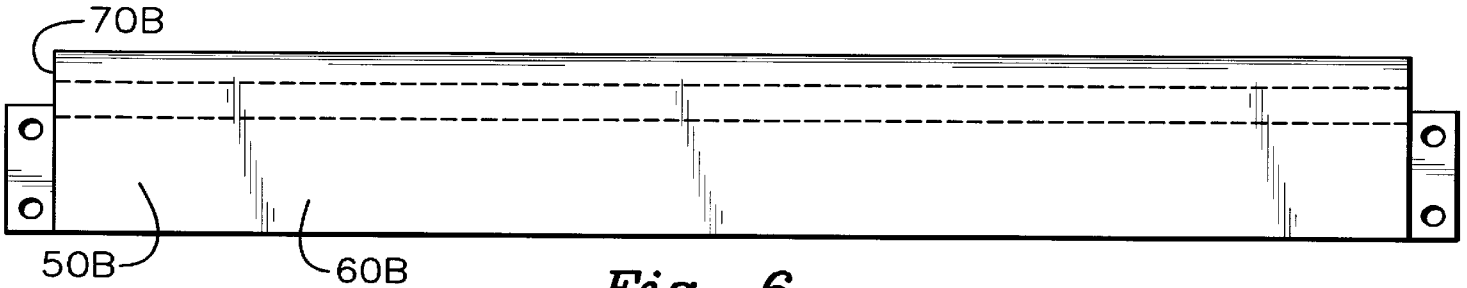
FIG. 6 is a side elevational view of a side member of the base top member from an outside view.
Figure 7:
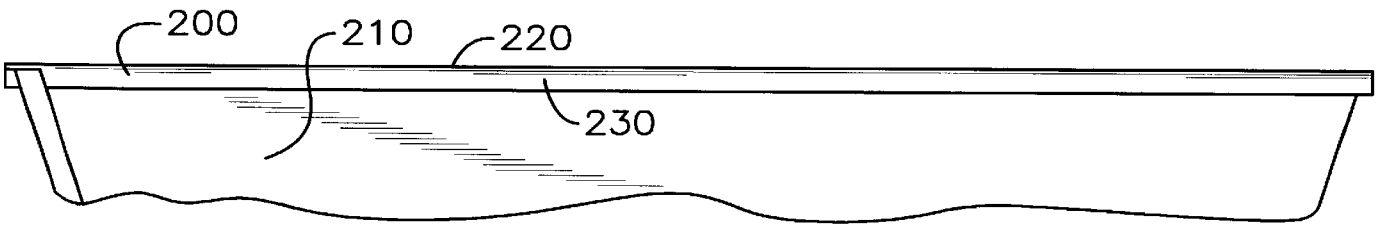
FIG. 7 is a side view in section of the insert member.

The subject apparatus is centered an improved sand and water table and a liner structure for such table; such sand and water table comprising a supported table having a depressed container area, which is open at the top for access from above, with an upper perimeter around the upper edge of the depressed container area, in which perimeter is formed a recessed channel area that functions for dual purposes, one being to help prevent spillage of sand, water, or other products from the depressed container area.

In the most general embodiment of the subject invention, the invention comprises a base member having a basin formed therein, such basin having a solid bottom surface with upwardly protruding perimeter walls forming with such bottom surface an open basin into which basin can be placed various substances such as sand, water, or other materials, which materials can be manually manipulated for play purposes. The uppermost extent of the walls form an upper perimeter surface edge which is generally horizontal when the member is placed in position for usage. The focus of the invention herein is a depressed ridge or channel formed into the upper perimeter surface edge in such a manner that the channel extends in a perimeter-like manner all the way around the upper perimeter surface edge of the base member. Stated alternately, the base member has formed in its upper most surface a recessed channel that descends downwardly into the base member from the upper surface edge, such channel either extending all the way around the upper surface edge in a perimeter-like manner or alternately, extending only a partial distance around the upper perimeter edge. This recessed channel, as stated, functions a dual purpose to help keep substances in the basin from landing over the top edges and additionally serves as a recessed portion into which the conformingly-shaped bottom perimeter edge of a covering lid can be placed to securely hold the covering lid in place.

The subject invention is focused on an apparatus centered on improved sand and water table, as used by young children for play and educational purposes, such sand and water table comprising an upright table having a depressed container area, which is open at the top for access from above with an upper table perimeter portion around the upper edge of the depressed container area, into which table perimeter portion is formed a recessed channel area that has dual functions, one being to help prevent spillage of sand, water, or other products from the depressed container area, with the additional inventive concept including an interior lining member that is adapted to fit conformingly into the open depressed container area, with the liner having an upper opening edge which opening edge is provided with an outwardly extending flat ledge adapted to rest on an inner portion of the perimeter portion of such table with an outer partially looped portion affixed to the outer perimeter of the flat ledge of the liner, which partially looped portion is adapted to fit conformingly over the most outer part of the table perimeter portion.

DESCRIPTION OF PREFERRED EMBODIMENT

The following description is of a preferred embodiment of the subject invention, and such description of a preferred embodiment is not to be construed as limiting the scope of the subject invention, as set forth in the annexed claims. Thus, the fact that one embodiment is described in the following description does not preclude the inclusion of other embodiments within the scope of the claims. Moreover, while the subject invention is focused and centered on a table member, the invention can be structured and deployed other than as a table member.

Referring now to the drawings in which a preferred embodiment of the subject invention is shown, a table member 10 is shown as being structured with an upright base member 15, with multiple vertical leg members 20A, 20B, 20C and 20D, depending from the bottom surface 25 of the base member 15.

Base member 15, as structured in the preferred embodiment is tantamount to a table top. It is to be noted that the fact that the invention described herein is set forth as a table member with vertically disposed supporting legs does not alter the aspect that the subject invention need not be formulated, structured, or incorporated in a table as such, as the subject invention need not be focused on a table member, but can be incorporated in a structured member that is not a table structure having legs. In short, the invention herein can be incorporated in most any type of structure having a recessed, open basin that can be filled with sand, water or other substances, as more fully described below.

Moreover, it is to be stressed that by describing the table 10, with top base member 15 having four supports, with legs 20A, 20B, 20C and 20D, with a rectangularly-shaped top member 15 as described and shown, with top base member 15 and supporting legs 20A, 20B, 20C and 20D does not preclude base member from having other shapes and supporting means. These variations may include, among other variations, other than employing such vertical support legs 20A, 20B, 20C and 20D for support purposes, and may have any number of legs or none at all, and yet still fall within the scope of the subject invention.

Attention is again directed to the drawings, which, as stated, show table 10 with top base member 15 having four affixed supporting legs 20A, 20B, 20C and 20D affixed to the bottom surface 25 of top base number 15. Top base members is formed, in the preferred embodiment, as having a hollow interior spatial area 30 that is open at the top forming thereby an upper opening 40 exposed from above the top base member 15. In the preferred embodiment, the interior spatial area 30 in the base top base member 15 is simply and solely formed by vertical side walls 50A, 50B, 50C and 50D, with no solid bottom surface and no upper surface. Alternately stated, in the preferred embodiment of the subject invention, the upper base top base member is basically formed and comprised solely by four vertical walls 50A, 50B, 50C and 50D joined together on their respective end edges in a box-like manner and rectangular fashion, with the supporting legs 20A, 20B, 20C and 20D depending downwardly in a vertical manner from the corner joints when respectively adjoining side edges of sides 50A, 50B, 50C, and 50D are joined. Thus, in the preferred embodiment the top base member 15 is formed as an empty shell formed solely of vertical, slab-like sides with no bottom or top surfaces, and an open area 30 in between the respective inner surfaces 60A, 60B, 60C and 60D of vertical sides 50A, 50B, 50C, and 50D respectively.

As can be further seen in the drawings, integrally formed on the upper portions of the inner surfaces 60A, 60B, 60C and 60D of vertical sides 50A, 50B, 50C and 50D are longitudinally extending ledges 70A, 70B, 70C and 70D respectively, with each such ledge extending along the entire longitudinal portion of each vertical side, at the same distance below the uppermost edges 80A, 80B, 80D(SIC) and 80D of each vertical side 50A, 50B, 50C and 50D. As can be seen in the drawings, particularly the end elevational views, the longitudinal ledges 70A, 70B, 70C and 70D are shaped with an inwardly extending and longitudinally structured bottom base portions 90A, 90B, 90C and 90D, such base portions on each ledge extending generally in a perpendicular direction away from the vertical inner surfaces 60A, 60B, 60C and 60D of each such vertical sides 50A, 50B, 50C and 50D. Integrally affixed to the distal edges 100A, 100B, 100C and 100D, which are the edges most distal from the conjoined vertical sides 50A, 50B, 59C or 50D of the bottom base portions 90A, 90B, 90C and 90D, are longitudinally extending, partially upright, arm members 110A, 110B, 110C and 110D. The latter longitudinally extending arm members 110A, 110B, 110C and 110D are thus joined on their lower ends to the distal edges 100A, 100B, 100C and 100D of the bottom base portions 90A, 90B, 90C and 90D of the ledges 70A, 70B, 70C and 70D, with the upper edges 120A, 120B, 120C and 120D of such longitudinally extending upright arms 110A, 110B, 110C, and 110D projecting upwardly. As seen in the drawings, an interior, longitudinally extending channel 130A, 130B, 130C, and 130D is formed within each ledge 70A, 70B, 70C and 70D by the upright arm 110A, 110B, 110C and 110D and the upper part of the bottom base portion and the juxtaposed inner surface 60A, 60B, 60C and 60D of each vertical side 50A, 50B, 50C and 50D. By this structural relationship, the longitudinally extending channels 130A, 130B, 130C and 130D are recessed with the opening to each such channel being formed respectively by the upper portions of ledges 70A, 70B, 70C and 70D and the upper portions of vertical sides 50A, 50B, 50C and 50D such that the respective channels 130A, 130B, 130C and 130D depend downwardly from each such opening.

Further, as can be seen in the drawings, in the preferred embodiment of the subject invention, the upper edges 80A, 80B, 80C and 80D of the vertical sides 50A, 50B, 50C and 50D extend slightly higher than the upper edges 120A, 120B, 120C, and 120D of the upright arms 110A, 110B, 110C and 110D. By this latter relationship, the longitudinally extending channels 130A, 130B, 130C and 130D thus have greater depth on the portion closest to the adjoining side 50A, 50B, 50C and 50D, as seen in the drawings.

When all the vertical sides of 50A, 50B, 50C and 50D of top base member are joined together, each ledge member 70A, 70B, 70C and 70D, preferably with beveled ends, are joined together to form a continuous ledge member on the inside surfaces of the base top member 15 such that the respective channels 130A, 130B, 130C and 130D become unified as one continuous perimeter channel member 130 on such inside surface.

In the preferred embodiment of the subject invention, a rectangular tray member 200 having a recessed basin 210 and having an upper perimeter edge 220 is adapted to be placed over the top of the conjoined ledge members 70A, 70B, 70C and 70D. More particularly, the rectangular tray member 200 is formed with an upper perimeter edge 220 that has a downturned rimmed portion 230 that extends over the edge 220 of the tray. The edge 220 and downturned portioned 230 of the tray are shaped and sized to fit conformingly over the outer arms 110A, 110B, 110C and 110D of the ledges 70A, 70B, 70C, and 70D so that the tray 200 is supported over such arms with the downwardly turned portions of such tray 200 being slightly higher than the upper edges 120A, 120B, 120C and 120D of the upright arms 110A, 110B, 110C and 110D. By this latter relationship, the longitudinally extending channels 130A, 130B, 130D and 130D and thus the unified channel 130 has a greater depth on the portion closest to the adjoining side 50A, 50B, 50C and 50D, as seen in the drawings.

When all the sides 50A, 50B, 50C and 50D of top base member 15 are joined together, each ledge member 70A, 70B, 70C and 70D, preferably with beveled ends, are joined together to form a continuous ledge member on the respectively adjoining inside surfaces of the top base member partially inserted into the unified perimeter channel 130 extending around on the unified ledge formed by respective upper edges 80A, 80B, 80C, and 80D. In the preferred embodiment, the downwardly turned edge of tray 200 does not fill the entire width of the unified channel 130.

The tray member 200, as stated, is formed with a recessed basin 210 that is open at the top. The basin 210 is the area in which sand, water and other substances can be placed for work or play purposes. The tray member 200 can be removed by lifting it off the unified ledge formed by upper edges 80A, 80B, 80C and 80D for cleaning or other purposes.

Moreover, a lid member, not shown, may be provided for covering the basin 210 when not used. This lid member would have a bottom edge shape that would conform to the size, structure, and shape of the unified ledge and unified channel 130 so that the lid fits conformingly into a part of the unified perimeter channel 130 just inside the inside surfaces 60A, 60B, 60C and 60D of the side walls 50A, 50B, 50C and 50D.

The recessed basin 210 in tray 200 is formed by a bottom surface 350, which is flanked by four vertical side walls 360A, 360B, 360C and 360D. The vertical side walls each have an upper edge surface 370A, 370B, 370C and 370D, and since these vertical side walls are all joined together at their respective vertical side edges, they form a continuous and solid vertical side wall protection that basically and generally forms the vertical part of the recessed basin 210 in tray 200, and since these side walls are continuous on the bottom edges with the horizontal side edges of the bottom surface 350 of the basin 210, the recessed basin is effectively an enclosed member having continuous, solid surfaces enclosing the basin 210, except for an opening 390 on the upper part of the basin that exposes the basin to the outside and provides access from above to the basin for a person to work with the contents of the basin.

In summary, the basic structure of the inner-recessed container member is thus that of an open bin or basin, that is open at the top having upwardly extending perimeter edges that provide the perimeter boundaries of the container for purposes of containing the sand, water, etc. within the confines of the open bin. As can be observed, the outer perimeter of the bin-like container is formed by opposing side walls. As further can be seen are the upper edges or upper surfaces of the side walls that have some minimal thickness and width into which a recessed channel is formed. In further summary, the subject invention is a water table for functional use comprising a table member having supporting legs, such table member having an upper platform with container means disposed in the upper surface of such table member. Additionally, the subject container is a functional member having a depressed basin in a portion of such member, such depressed basin being open at the top and adapted to hold substances to be manually manipulated, such functional member having an upper surface surrounding a portion of such depressed basin, which such upper surface having an outer perimeter edge, with such upper surface having on a portion thereof a vertically upwardly protruding ledge that extends upwardly beyond the uppermost portion of such upper surface.

Figure 10:
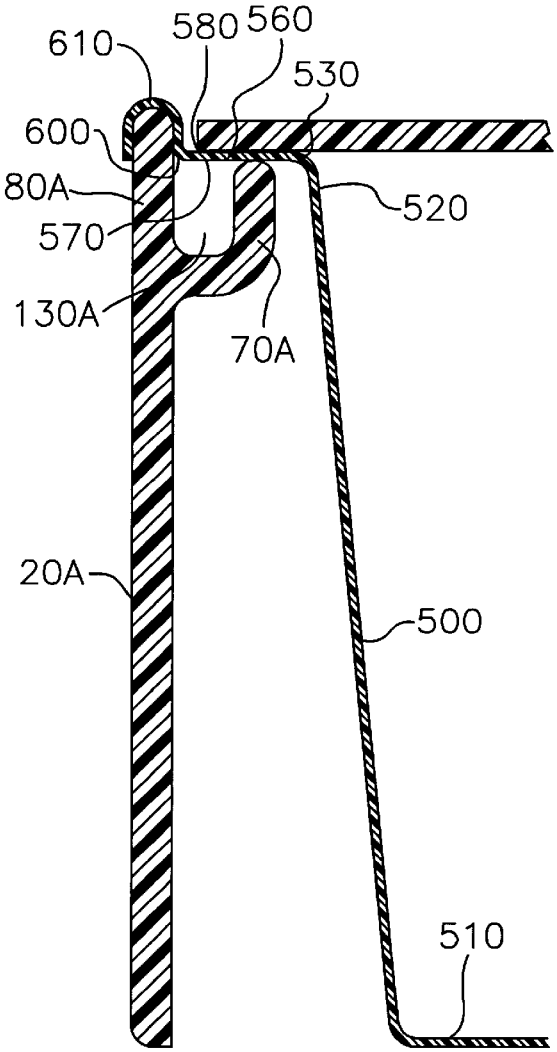
FIG. 10 is a side elevational view demonstrating a structure of the subject device.
Figure 11:
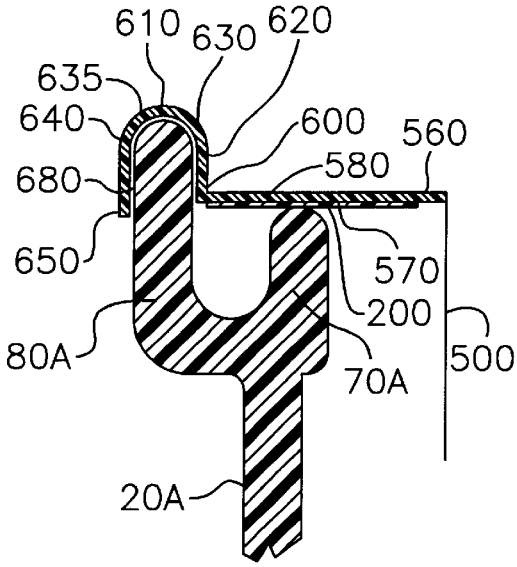
FIG. 11 is a side elevational view which is an enlarged view of the upper arm portion of the subject invention incorporating features of the subject invention.

In the preferred embodiment of the subject improvement invention, as seen in FIGS. 10 and 11 a lining member 500 is provided, which lining member has a closed bottom portion 510 and an upper portion 520. The closed bottom portion 510 of lining 500 is adapted to rest generally flush against the bottom surface 350 of recessed basin 210 while the upper portion of such lining is open, being rimmed and formed by an upper perimeter edge 530. As can be seen, such perimeter edge 530 of the lining member 500 is formed, as seen in the cross-sectional view of FIGS. 10 and 11 with an outwardly protruding upper horizontal ledge 560, which upper horizontal ledge in the preferred embodiment has a flat undersurface 570 and a flat upper surface 580. It is to be stressed, however, that the upper surface 580 and lower surface 570 respectively of ledge 560 may be other than flat or horizontal. For example, the lower surface 570 of the upper ledge 560 may have a linear extending indentation not shown, which linear indentation extends longitudinally along the lower surface of the ledge 570 in a direction generally parallel to the outer surface of side member formed by vertical sides 50A, 50B, 50C, 50D of the table member 10, and along the longitudinal extent of the ledge 530.

More particularly, the upper perimeter ledge 560 of the lining 500 extends, in the preferred embodiment, all the way around the upper perimeter edge 530 of the lining 500 as seen in the drawings. The upper ledge 560 of lining 500 is generally disposed in a horizontal direction, substantially, but not completely, perpendicular to the respective adjoining side wall. Moreover, the upper ledge 560 of lining 500 is adapted to be perpendicular to the respective sides 50A, 50B, 50C, and 50D of table member 10 as seen in the drawings and particularly in FIG. 10 where such perpendicular relationship is demonstrated.

Furthermore, shown in FIG. 10 an integral feature of the subject invention, which is an additional outer extension of upper ledge 560. Again, as seen in the cross-sectional feature of FIG. 10 the ledge 560 is shown as having an outer perimeter extent 600 which outer perimeter extent defines a portion of the ledge 560 where the flat, horizontal portion of the ledge 560 of lining 500 ends. At this portion of the ledge 560 where the flat portion ends, there is an upwardly extending loop portion 610, seen in FIG. 10 that resembles an inverted U-shape, so that it appears in such cross-sectional view as a downwardly depending hooking that has its opening facing down, with the U-shaped member inverted downwardly. More particularly, the loop portion 610 is comprised of an upwardly extending leg 620 that is joined on its bottom end to the outer perimeter portion of the horizontal ledge 560 with the inner end 630 of the upper bend portion 635 being affixed to the upper end of the leg 620, and the outer end of the curved bend portion 635 being affixed to the upper end 640 of the outer vertically depending leg 650. By this latter constructional arrangement, the vertical legs 620 and 650 of the looped portion 610 form an opening 680 that can be inserted downwardly somewhat conformingly over the top of the outer arms 80A, 80B, 80C 80D, as seen.

These above-described features are set forth and described from a limited perspective (i.e., a cross-sectional configuration) and it must be indicated, in this respect, that the outer surface formed by the upper portions of the outer arms 80A, 80B, 80C and 80D with the upper outer loop portion each extend coextensively all the way around the upper perimeter edge of the lining 500 as seen in the drawings. Thus, the loop portion 610 of liner 500 as joined to the upper ledge member 560 extends as a continuous member all the way around, in perimeter fashion, around the upper part of the liner 500. By this arrangement, the upper ledge 560 and loop portion 610 of liner 500 will thence be adapted to fit, by proper matching of perimeter sizing of the lining 500 to the table's cover the table from moisture leakage into and out of the table. More particularly, the ledge 560 of liner 500 will be adapted to rest on top of the table perimeter inside the vertical outer arms 80A, 80B, 80C, 80D, and the looped portion 610 will rest over the top part of such arms as seen. This will seal all areas of the table from moisture and debris ingress and egress.

What is claimed is:

1. A water table liner in combination with a water table assembly comprising:

(a) a water table having an upper water table surface, with the upper outer perimeter of said water table surface having a depressed channel around said upper outer perimeter of said water table surface and wherein said channel is formed with an upwardly extending inner arm and an upwardly extending outer arm, said outer arm extending higher above the upper outer perimeter of said upper water table surface than said upper extending inner arm;

(b) container means disposed on the inner arm of said water table;

(c) liner means for said water table comprising a liner member that fits over said water table and loops over the outer arm on said upper water table surface around the upper outer perimeter of said table.

2. A liner in combination with a table assembly having a table top with an upper surface comprising:

(a) an upper table assembly and a lower table assembly, on said table assembly, said table assembly having support members for holding said table top of said table assembly, said table top having an upper surface, and an outer perimeter edge with an upper extending ridge member over said upper surface of said table top, said upper extending ridge member being on said outer perimeter edge and extending completely about said outer perimeter edge, said ridge member extending upwardly above said table top of said table assembly;

(b) recessed basin means extending downwardly from said table top, said recessed basin means having an upper opening, the outer perimeter of said opening being positioned on a part of said upper table assembly;

(c) a channel extending downwardly into said table top with the upper portion of said channel being formed by an outer upwardly extending arm and an inner upwardly extending arm separated from the outer upwardly extending arm, with said outer upwardly extending arm being higher than the inner arm said outer perimeter of said recessed basin means being positioned on said inner arm;

(d) a lining member having an open spatial area and an enclosed bottom adapted to rest on the bottom of said recessed basin means with such lining member having an outer lining perimeter ledge wherein the outer lining perimeter ledge is disposed over said outer arm on said table assembly.

* * * * *